US005992659A

United States Patent [19]

Nofer et al.

[11] Patent Number: 5,992,659

[45] Date of Patent: Nov. 30, 1999

[54] TAMPER PROOF FLIP TOP CAP

[75] Inventors: Karl H. Nofer; Jozef Krajnc, both of Kitchener, Canada

[73] Assignee: Pano Cap (Canada) Limited, Kitchener, Canada

[21] Appl. No.: 08/936,995

[22] Filed: Sep. 25, 1997

[51] Int. Cl.[6] ..... B65D 43/16; B65D 55/02

[52] U.S. Cl. ..... 215/235; 215/330; 222/541.9; 222/556

[58] Field of Search ..... 215/235, 237, 215/254, 256, 263, 303, 306, 330; 220/254, 258, 259, 291, 292, 375, 837; 222/556, 568, 541.9, 564, 547

[56] References Cited

U.S. PATENT DOCUMENTS

| | | | |
|---|---|---|---|
| 4,487,324 | 12/1984 | Ostrowsky | 215/235 X |
| 4,747,498 | 5/1988 | Gach | 215/235 X |
| 4,821,899 | 4/1989 | Nycz et al. | 215/235 |
| 5,096,077 | 3/1992 | Odet et al. | 215/235 X |
| 5,143,234 | 9/1992 | Lohrman et al. | 215/235 |
| 5,143,237 | 9/1992 | Lindsey et al. | 215/330 |
| 5,145,080 | 9/1992 | Imberry, Jr. | 215/330 X |
| 5,203,838 | 4/1993 | Schneider | 215/235 X |
| 5,593,055 | 1/1997 | Repp et al. | 215/256 |
| 5,642,824 | 7/1997 | Hess, III et al. | 215/235 |
| 5,676,270 | 10/1997 | Roberts | 215/330 |
| 5,785,193 | 7/1998 | Kobayashi et al. | 215/235 |
| 5,806,698 | 9/1998 | Aguirrezabal | 215/235 |

*Primary Examiner*—Stephen K. Cronin
*Assistant Examiner*—Nathan Newhouse
*Attorney, Agent, or Firm*—Daryl W. Schnurr

[57] ABSTRACT

A tamper evident flip top pouring closure is designed for use with a corresponding container. A tamper evident flip top pouring closure and container in combination has a closure with a screw thread thereon together with interlocking means and a container with the corresponding screw thread and corresponding interlocking means. The interlocking means prevents the removal of the closure from the container once the closure is installed on the container. The interlocking means on the closure are a series of tabs that are connected to the closure and extend inward at an angle. The interlocking means on the closure are two sets of saw-teeth having a gentle slope on one side and a steep slope on another side. The closure is then installed on the container and cannot be removed because the tabs abutt a steep slope of the saw-teeth and will not override the saw-teeth in a reverse direction.

10 Claims, 2 Drawing Sheets

TAMPER PROOF FLIP TOP CAP

BACKGROUND OF THE DISCRIPTION

1. Field of the Invention

This invention relates to an improved tamper evident flip top pouring closure for use with a container having a neck with an opening therein. Further, this invention relates to an improved tamper evident flip top pouring closure and container in combination and to a method of construction thereof.

2. Description of the Prior Art

Flip top pouring closures are known where the closure has a central sealing diaphragm. The diaphragm has a loop connected thereto and is scored around a periphery so that the diaphragm can be permanently removed and discarded by manually pulling on the loop (see U.S. Pat. Nos. 3,459,315, 4,356,939, 3,610,484, 4,179,044 and 5,301,849). These closures are usually connected to the container by a skirt that extends outside of the neck of the container. The skirt has a ridge extending along an inner circumference and the neck has a corresponding channel extending along its outer circumference. During installation, when the closure is pushed onto the neck of the container, the ridge slides into the channel to retain the closure on the neck. The flip top is then opened to expose the loop and sealing diaphragm. A consumer pulls the loop to remove the diaphragm and the diaphragm is discarded. Thereafter, the container is opened and closed by opening and closing the flip top. While the sealing diaphragm provides a tamper evident barrier, a disadvantage of these closures is that the entire closure can be pulled off the container so that the ridge slides out of the channel. The contents of the container can then be tampered with without disturbing the sealing diaphragm and the closure can be re-installed on the container by pushing the closure onto the neck until the ridge once again engages the channel. Thus, the tamper evident feature can be circumvented fairly readily.

When the previous closures have a flip top that is connected to the remainder of the closure by a hinge, the closures are made from polypropylene. If polyethylene is used, which is the most common material used for closures, the hinge will fail prematurely as it will break after a fairly small number of openings and closings. The use of polypropylene overcomes the problem with the hinge but the sealing diaphragm can be difficult to remove when the closure is made from polypropylene. This is particularly apparent when the hinge is a live hinge that snaps toward the closed position as it approaches that position. For large caps that have a large diameter, the sealing diaphragm and the loop can be made quite large so that it is easy to tear the diaphragm away from the rest of the closure even when the closure is made of polypropylene. However, for small diameter closures, for example, closures having a diameter of approximately one inch, it is much more difficult to remove the sealing diaphragm when polypropylene is used to make the closure. The loop is quite small and can only be grasped by a thumb and index finger of a user. The force that can be applied to the loop is not very strong. Some consumers have been known to resort to using tools such as a pliers or a kitchen utensil to remove the sealing diaphragm from these types of closures. Some manufacturers have attempted to overcome this problem by manufacturing closures of two different materials, one for the hinge portion and one for the diaphragm portion. It is very difficult to manufacture the closure within one mold from two different materials. It is also much more expensive and time consuming as the mold must be filled to a certain extent with one material and then filled the rest of the way with another material.

SUMMARY OF THE INVENTION

It is an object of the present invention to provide a tamper evident flip top pouring closure that is extremely difficult to remove from a container after it has been installed thereon without noticeably damaging the closure. It is a further object of the present invention to provide a closure that has a long lasting hinge as well as a sealing diaphragm with a loop thereon that can be removed easily, without the use of tools, from caps having a small diameter.

A tamper evident flip top pouring closure is intended for use with a container having a neck with an opening therein, said neck having an outer surface with a screw thread and interlocking means thereon. The closure has a tubular body with a throat portion insertable into said opening and a skirt spaced outwardly from said throat portion and connected thereto for disposition circumferentially outside of said neck. An extension of said throat portion defines a pouring spout. A ceiling diaphragm is mounted transfersely of said throat portion to close said throat portion. A tear-member is connected to said diaphragm for tearing out said diaphragm by pulling on said member. The closure has a flip top connected to said tubular body by a hinge. The flip top has an open position and a closed position. The flip top covers the throat portion in said closed position. The skirt has a screw thread and interlocking means on an inner surface thereof. The screw thread of said skirt corresponds to said screw thread on said container. The interlocking means on said skirt corresponds to interlocking means on said container. The interlocking means on said skirt overrides said interlocking means on said container when said closure is turned on to said container. The interlocking means of said closure in said container interlock with one another when said closure is attempted to be turned off said container. A tamper evident pouring closure and a corresponding container in combination has a container comprising a neck with an opening therein, said neck having an outer surface with a screw thread thereon and interlocking means thereon. The closure comprises a tubular body having a throat portion insertable into said opening and a skirt spaced outwardly from said throat portion and connected thereto for disposition circumferentially outside of said neck. An extension of said throat portion defines a pouring spout. A ceiling diaphragm is not to transversely of said portion to close said throat portion. A tear-member is connected to said diaphragm for tearing out said diaphragm by pulling on said member. The closure has a flip top connected to said tubular body by a hinge, said flip top having an open position and a closed position. The flip top covers said throat portion inside closed position. The skirt has a screw thread and interlocking means on said inner surface thereof, said screw thread corresponding to said screw thread of said container. The interlocking means on said closure override said interlocking means on said container when said closure in turned on to said container but interlocking with one another when said closure is attempted to be turned off said container.

A method of constructing a tamper evident flip top pouring closure, said method comprises locating a screw thread and an interlocking means on an interior surface of a skirt, said skirt being located outside of a neck of a corresponding container when said closure is installed on to said container, said interlocking means allowing installation of said closure on said container but preventing removal of said closure from said container.

DETAILED DESCRIPTION OF A PREFERRED EMBODIMENT

Figure 1:
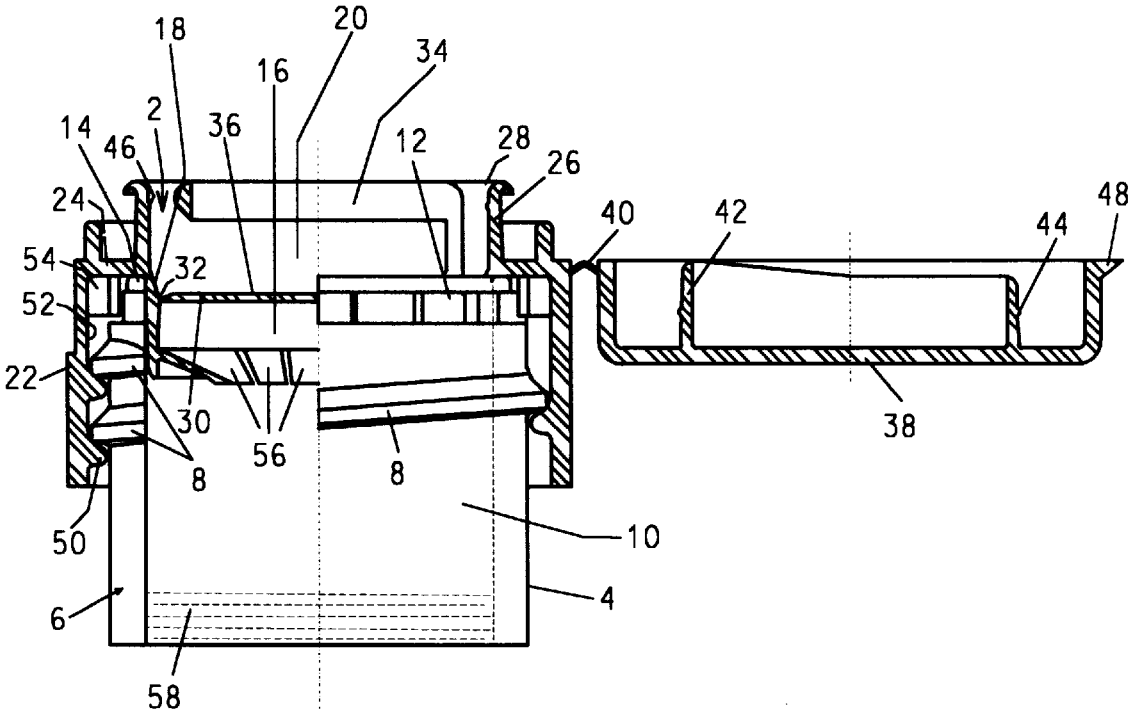
FIG. 1 is a side view of a closure installed on a neck of a container, said view being partially in section and said flip top being open.

Referring to FIG. 1 in greater detail, a closure 2 is installed on a neck 4 of a container 6. The neck 4 has a screw thread 8 on an exterior surface 10 thereof as well as interlocking means 12 on said exterior surface 10 near a top 14. The neck 4 has an opening 16 therein (best seen in FIG. 5).

Figure 2:
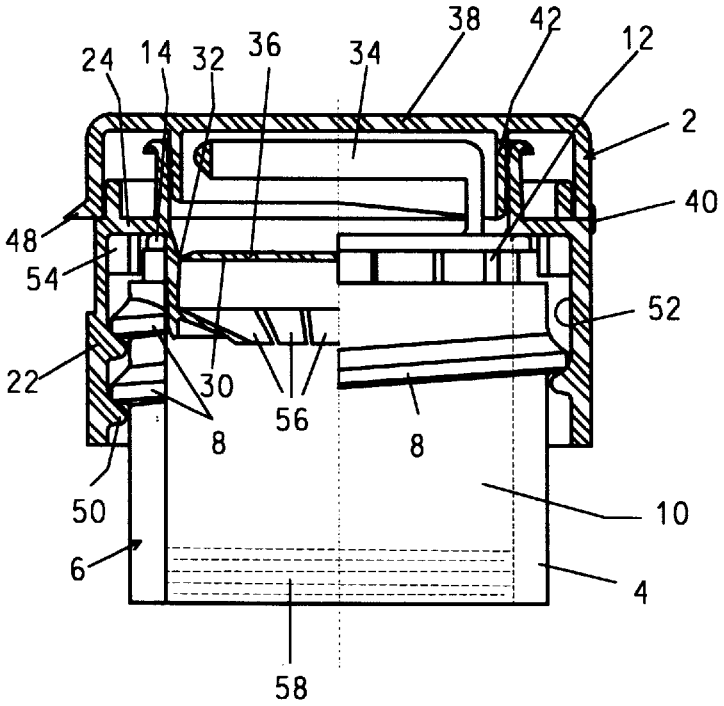
FIG. 2 is a side view of a closure and partial container of FIG. 1 where the flip top is in a closed position.

The closure 2 has a tubular body 18 having a throat portion 20 that is inserted into the opening 16. The closure 2 also has a skirt 22 spaced outwardly from said throat portion 20 and connected thereto by a flange 24 for disposition circumferentially outside of said neck 4. An extension 26 of said throat portion 20 defines a pouring spout 28. A sealing diaphragm 30 is mounted transversely within said throat portion 20 to close said throat portion. The diaphragm has a reduced thickness around a periphery 32 thereof. A tear member 34 is a loop connected to an outer surface 36 of the diaphragm 30. When the loop is pulled outward, the diaphragm is torn out of the closure and is discarded. The closure 2 has a flip top 38 connected thereto by a hinge 40. The flip top 38 has a cylindrically shaped seal 42 that extends into the throat portion 20 when the closure is in the closed position shown in FIG. 2. The seal 42 has a nodule 44 that overrides a corresponding nodule 46 in the interior of the throat portion 20 when the flip top is closed. The two nodules 44, 46 of the flip top 38 and throat portion 20 respectively override one another when the flip top is opened or closed and provide further resistance to retain the flip top in a closed position until the overriding force is overcome by a consumer exerting pressure on the flip top in a direction away from the container 6. Preferably, the pressure is applied to a small lip 48 located on the flip top on a side opposite to the hinge 40.

The skirt 22 has a screw thread 50 on an inner surface 52 thereof. The screw thread 50 of the closure 2 corresponds to the screw thread 8 of the container 6. The inner surface 52 has interlocking means 54 located thereon just beneath the flange 24 when the closure 2 is in an upright position. The interlocking means 54 of the closure 2 corresponds to the interlocking means 12 of the container 6. When the closure 2 is installed on to the container 6 in the position shown in FIGS. 1 and 2, the interlocking means 12, 54 of the container 6 and closure 2 respectively are interlocked with one another and the screw threads 8, 50 are engaged. The throat portion 20 contains a plurality of baffles 56 extending inward and downward therefrom. The baffles 56 are spaced apart from one another and provide means to disrupt the flow of fluid 58 out of the container so that air can enter the container as the fluid exits to allow the fluid to flow out of the container through the throat portion 20 in a smooth manner. By comparing FIGS. 1 and 2 and the shape of the hinge 40, it can be seen that the hinge 40 is bowed in one direction in the closed position and bowed in an opposite direction in the open position. Since the hinge 40 is bowed, it bends over its length rather than along a single line. If the hinge were to bend along a single line, then all of the stress of opening and closing the hinge would be along that line. Since the hinge is designed to bow along its length, the stress of opening and closing the flip top is spread throughout the hinge, thereby prolonging the life of the hinge.

Figure 3:
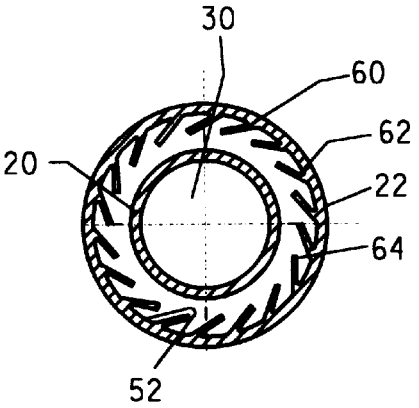
FIG. 3 is a sectional view of a closure when viewed from a bottom just below interlocking means on said closure.

In FIG. 3, it can be seen that the interlocking means of 54 of the closure 2 is a series of rectangular shaped tabs 60. The tabs 60 have an outer fixed end 62 that is connected to the inner surface 52 of the skirt 22 and an inner free end 64. The free end 64 of each tab 60 is free to move inward and outward relative to the fixed end 62.

Figure 4:
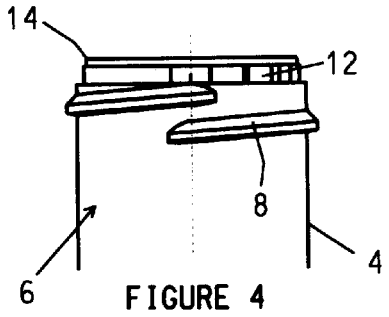
FIG. 4 is a side view of a container with the closure removed.
Figure 5:
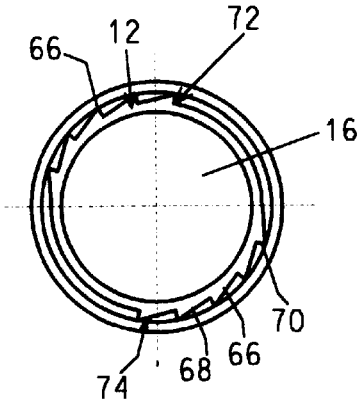
FIG. 5 is a top view of the container of FIG. 4.
Figure 6:
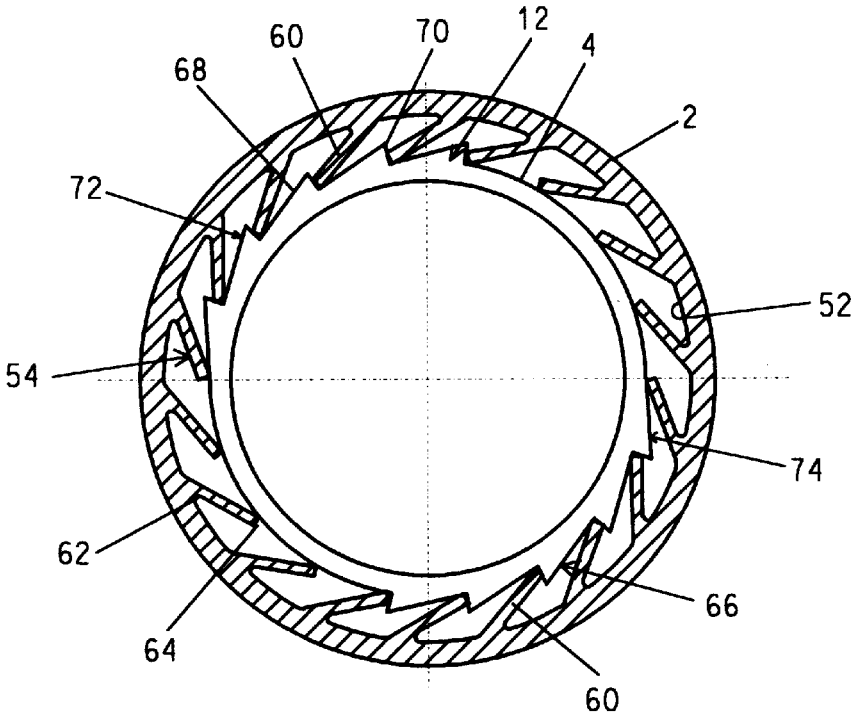
FIG. 6 is a schematic partial sectional view of interlocking portions of the closure and the container.

From FIGS. 4 and 5, it can be seen that the neck 4 of the container 6 surrounds the opening 16. The exterior surface 10 has the screw thread 8 as well as the interlocking means 12 located thereon. The interlocking means is located above the screw thread when the container is in an upright position. From FIG. 6, it can be seen that the interlocking means 12 is a series of saw-tooth projections 66 that have a gentle slope 68 and a steep slope 70 on each saw-tooth 66. Also, it can be seen that there are two distinct series 72,74 of saw-tooth projections 66 located approximately 180 degrees apart from one another. The saw-tooth projections 66 cannot extend completely around the container 6 because the container could not be removed from the mold from which it is made without damaging the saw-teeth. By locating the saw-tooth projections 66 in two separate series 72,74, as shown in FIG. 5, the mold can be split to open tangentially in that area of the surface 10 between the two series 72,74. From FIGS. 3 and 5, it can be seen that as the closure 2 is inserted onto the container 6, the corresponding screw threads 50,8 will engage one another and the tabs 60 of the interlocking means 54 of the closure 2 will bend to override the gentle slopes 68 of the saw-tooth projections 66. However, as shown in FIG. 6, when the closure 2 is tightened onto the container 6, the free ends 64 of the tabs 60 will abut the steep slopes 70 if the closure 2 is attempted to be turned off the container 6. The tabs 60 cannot bend sufficiently to override the saw-tooth projections 66 in the reverse direction as the lateral space on either side of the tabs 60 is quite constricted. Alternatively to the tabs 60, the closure 2 could have saw-tooth projections of a similar size and shape to the saw-tooth projections 66 of the container 6.

When the closure 2 is installed onto the container 6, it cannot be removed without damaging the closure, or the container or both. In either case, the damage will be readily apparent to a consumer of the product before the product is purchased. Also, if the closure and container have been tampered with by removing the diaphragm 30, that will also be apparent to the consumer.

A great deal of difficulty was encountered with the present invention in finding a material that was strong enough to provide a hinge for the flip top that would clearly outlast a consumer's use of the fluid within the container and yet weak enough or brittle enough that the diaphragm could be readily removed from the container by pulling on the loop 34 using the thumb and one finger. When the closures have a small diameter, for example, one and a half inches or less, the loop is necessarily quite small and there is no room to insert a finger through the loop. The loop must be grasped by contacting a finger on one side of the loop with the thumb on the other side of the loop. This does not permit the consumer to apply a great deal of force to the loop. It was found that when polyethylene was used to make the closure, the diaphragm could be readily removed but the hinge failed when the flip top was opened only a few times. It was also found that when the closure was made of polypropylene, the hinge would be long lasting but the diaphragm could not be readily removed by grasping the loop with the thumb and one finger where the loop was too small to permit the insertion of a finger through the loop. It has been found, after a great deal of experimentation, that when the closure is made from high density polyethylene, the hinge is long lasting through many, many openings and closings of the flip top, yet the diaphragm is readily removable, even for small closures. An example of high density polyethylene is Dow HDPE 25455N (a trademark). When polyethylene is referred to in this specification, it shall be considered to be low density polyethylene. An example of low density polyethylene is Dow LDPE 955I (a trademark). High density polyethylene has a much higher tensile strength than polyethylene.

The container of the present invention is designed to be used both with a closure having a screw thread with interlocking means and without interlocking means thereon. A closure without interlocking means can easily be removed from the container and therefore the contents can be tampered with. However, some fluids are not susceptible to tampering. For example, tamper evident protection is not required for many non-edible fluids such as cleaning liquids, such as soaps and detergents, floor cleaners etc. The container has an advantage in that its use is not restricted to tamper evident closures.

I claim:

1. A tamper evident flip top pouring closure for use with a container having a neck with an opening therein, said neck having an outer surface with a screw thread and interlocking means extending radially outward therefrom, said closure comprising a tubular body having a throat portion insertable into said opening and a skirt spaced outwardly from said throat portion and connected thereto for disposition circumferentially outside of said neck, an extension of said throat portion defining a pouring spout, a sealing diaphragm mounted transversely of said throat portion to close said throat portion, a tear-member connected to said diaphragm for tearing out said diaphragm by pulling on said member, said closure having a flip top connected to said tubular body by a hinge, said flip top having an open position and a closed position, said flip top covering said throat portion in said closed position, said skirt having a screw thread and interlocking means extending inwardly on an inner surface thereof, said screw thread of said skirt corresponding to said screw thread on said container, said interlocking means on said skirt being located to correspond to interlocking means on said container, said interlocking means of said closure being a plurality of tabs, said tabs being flexible laterally to ride over said interlocking means of said container when said closure is turned on to said container and being stiff longitudinally to interlock with said interlocking means of said container when said closure is attempted to be turned off said container.

2. A closure as claimed in claim 1 wherein the interlocking means on the closure is located at or near a top of said skirt.

3. A closure as claimed in any one of claims 1 or 2 wherein the closure is formed of high density polyethylene.

4. A closure as claimed in any one of claims 1 or 2 wherein said tear-member is a loop connected to said diaphragm.

5. A closure as claimed in any one of claims 1 or 2 where the hinge is bowed.

6. A tamper evident pouring closure and a corresponding container in combination, said container comprising a neck with an opening therein, said neck having an outer surface with a screw thread thereon and interlocking means extending radially outward, said closure comprising a tubular body having a throat portion insertable into said opening and a skirt spaced outwardly from said throat portion and connected thereto for disposition circumferentially outside of said neck, an extension of said throat portion defining a pouring spout, a sealing diaphragm mounted transversely of said throat portion to close said throat portion, a tear-member connected to said diaphragm for tearing out said diaphragm by pulling on said member, said closure having a flip top connected to said tubular body by a hinge, said flip top having an open position and a close position, said flip top covering said throat in said closed position, said skirt having a screw thread and interlocking means extending inwardly on an inner surface thereof, said screw thread corresponding to said screw thread of said container, said interlocking means on said closure being located to correspond to said interlocking means on said container, said interlocking means of said closure being a plurality of tabs, said tabs being flexible laterally to ride over said interlocking means of said container when said closure is turned on to said container and being stiff longitudinally to interlock with said interlocking means of said container when said closure is attempted to be turned off said container.

7. A closure and container in combination as claimed in claim 6 wherein said interlocking means of said closure is located at or near a top of said inner surface of said skirt and said interlocking means of said container is located at or near a top of an exterior of said neck.

8. A closure and container in combination as claimed in claim 7 wherein said interlocking means of said container extends partially around said outer surface of said neck.

9. A closure and container in combination as claimed in claim 8 wherein said interlocking means of said container extends partially around an exterior surface of said neck in two separated locations, said locations being substantially 180 degrees apart from one apart from one another.

10. A method of constructing a tamper evident flip top pouring closure for use with a container having a neck with an opening therein, said neck having an outer surface with a screw thread and interlocking means extending radially outward therefrom, said closure comprising a tubular body having a throat portion insertable into said opening and a skirt spaced outwardly from said throat portion for disposition circumferentially outside of said neck, a sealing diaphragm mounted transversely of said throat portion to close said throat portion, said closure having a flip top connected to said tubular body by a hinge, said flip top having an open position and a closed position, said flip top covering said throat portion in said closed position, said skirt having a screw thread and interlocking means extending inwardly on an inner surface thereof, said screw thread of said skirt corresponding to said screw thread on said container, said method comprising locating said screw thread and said interlocking means on said inner surface of said skirt, said skirt being located outside of said neck of said container when said closure is installed on to said container, said interlocking means extending inwardly and being a plurality of tabs, said tabs being flexible laterally, but stiff longitudinally, said interlocking means allowing installation of said closure on said container but preventing removal of said closure from said container.

* * * * *